US008555926B2

(12) United States Patent
MacDuff et al.

(10) Patent No.: US 8,555,926 B2
(45) Date of Patent: Oct. 15, 2013

(54) SUPPLY MANIFOLD FOR HYDRONIC SYSTEM

(76) Inventors: Malcolm MacDuff, Victoria (CA); James MacDuff, Victoria (CA)

( * ) Notice: Subject to any disclaimer, the term of this patent is extended or adjusted under 35 U.S.C. 154(b) by 510 days.

(21) Appl. No.: 12/872,614

(22) Filed: Aug. 31, 2010

(65) Prior Publication Data

US 2012/0048381 A1 Mar. 1, 2012

(51) Int. Cl.
*F16K 11/14* (2006.01)

(52) U.S. Cl.
USPC ..... 137/883; 74/129

(58) Field of Classification Search
USPC ..... 137/883, 887, 635; 237/59; 74/128, 129
See application file for complete search history.

(56) References Cited

U.S. PATENT DOCUMENTS 2,530,581 A 11/1950 Markis et al.
3,516,638 A * 6/1970 Piggott ..... 251/175
4,274,802 A * 6/1981 Inaba et al. ..... 414/783
4,687,941 A * 8/1987 Lasberg et al. ..... 250/506.1
4,890,648 A * 1/1990 Giordano ..... 137/594
5,533,549 A * 7/1996 Sherman ..... 137/557
5,707,007 A * 1/1998 Fiedrich ..... 237/81
5,937,890 A * 8/1999 Marandi ..... 137/271
7,162,884 B2 1/2007 Alles

* cited by examiner

*Primary Examiner* — John Fox
(74) *Attorney, Agent, or Firm* — Dority & Manning, P.A.

(57) ABSTRACT

A supply manifold for a hydronic heating or cooling system has a housing a plurality of valves disposed on respective outlets of the housing in a linear arrangement. Each outlet is adapted to connect to a conduit for delivering the liquid to a zone. Each valve controls a flow of the heating or cooling liquid into each respective conduit. The supply manifold has a single actuator for individually actuating one of the valves. A first displacement mechanism, e.g. a screw drive power by an electric motor, displaces the actuator along a longitudinal axis parallel to the linear arrangement of the valves to thereby access any one of the valves. A second displacement mechanism, e.g. a solenoid, displaces the actuator orthogonally to the longitudinal axis to thereby cause engagement or disengagement of the actuator with a selected one of the valves for opening or closing.

13 Claims, 5 Drawing Sheets

SUPPLY MANIFOLD FOR HYDRONIC SYSTEM

CROSS-REFERENCE TO RELATED APPLICATIONS

This application is the first application filed for the present invention.

TECHNICAL FIELD

The present invention relates generally to hydronic heating or cooling systems and, more particularly, to supply manifolds for hydronic heating or cooling systems.

BACKGROUND

Hydronic heating or cooling systems deliver warm or cool liquid through conduits to heat or cool surfaces such as floors (radiant floor heating/cooling) or walls (radiant wall heating/cooling). Some such systems deliver liquid through conduits to multiple zones. In conventional systems, multiple zone valves are used to regulate the flow of liquid to each of the conduits. In other words, there is one zone valve for every zone in the dwelling.

A problem with these multi-zone hydronic systems is that the supply manifold is complex and expensive, requiring individual actuators to actuate each of the zone valves.

In view of this shortcoming, an improvement on this prior art would thus be highly desirable.

SUMMARY

The present invention provides, in general, a novel supply manifold having a single displaceable actuator that may be displaced to individually actuate any desired one of a plurality of valves. This novel manifold may be incorporated within a hydronic heating system, a hydronic cooling system, a fire sprinkler system, or any other apparatus where a manifold employs multiple valves to control the flow of a liquid. Related to this novel manifold is a novel method of operating a hydronic heating or cooling system.

In accordance with one main aspect of the present invention, a novel supply manifold for a hydronic heating or cooling system, fire sprinkler or other such liquid distribution apparatus, includes a housing having an inlet and an internal chamber for receiving a heating or cooling liquid. The manifold also includes a plurality of valves disposed on respective outlets of the housing in a linear arrangement. Each outlet is adapted to connect to a respective conduit for delivering the heating or cooling liquid to a respective zone. Each of the plurality of valves controls a flow of the heating or cooling liquid from the internal chamber into each respective conduit. The manifold has but a single actuator for individually actuating one of the valves (rather than having one actuator per valve). The manifold has a first displacement mechanism, e.g. a screw drive driven by an electric motor, for displacing the actuator along a longitudinal axis that is parallel to the linear arrangement of the valves to thereby access any one of the valves. The manifold also has a second displacement mechanism, e.g. a solenoid, for displacing the actuator orthogonally to the longitudinal axis to thereby cause engagement or disengagement of the actuator with a selected one of the valves for opening or closing.

In accordance with another main aspect of the present invention, a method for operating a hydronic heating or cooling system entails steps of delivering a heating or cooling liquid into a supply manifold having a housing and a plurality of valves disposed on respective outlets of the housing in a linear arrangement, connecting each outlet to a respective conduit for delivering the heating or cooling liquid to a respective zone, and controlling each of the plurality of valves using the supply manifold. The manifold has but a single actuator unlike conventional manifolds which employ one actuator per valve. The method thus entails a step of displacing the actuator along a longitudinal axis that is parallel to the linear arrangement of the valves to thereby access any one of the valves. This may be done using a screw drive. The method further entails displacing the actuator orthogonally to the longitudinal axis to thereby cause engagement or disengagement of the actuator with a selected one of the valves for opening or closing. This may be accomplished, for example, using a solenoid. Finally, the method entails a step of causing the selected valve to rotate one quarter turn by further displacing the actuator along the longitudinal axis to thereby open or close the selected valve. This latter step may be accomplished, for example, by further advancing the screw drive once the solenoid is engaged.

In accordance with yet another main aspect of the present invention, a novel hydronic heating or cooling system includes a heater for heating a heating liquid (or a cooling apparatus for cooling the liquid), a pump for displacing the liquid through conduits to various zones, and a novel supply manifold. The novel manifold has a housing, a plurality of valves disposed on respective outlets of the housing in a linear arrangement, each outlet being adapted to connect to one of the conduits, and only a single actuator for individually actuating one of the valves. The manifold includes a first displacement mechanism, e.g. an electrically powered screw drive, for displacing the actuator along a longitudinal axis that is parallel to the linear arrangement of the valves to thereby access any one of the valves. The manifold includes a second displacement mechanism, e.g. a solenoid, for displacing the actuator orthogonally to the longitudinal axis to thereby cause engagement or disengagement of the actuator with a selected one of the valves for opening or closing.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

The present invention is directed to a novel supply manifold for a hydronic heating system, hydronic cooling system, fire sprinkler system or any other analogous liquid-distribution apparatus.

One exemplary embodiment of this novel supply manifold is depicted in FIGS. 1-5. It should be understood that this exemplary embodiment represents only one way of implementing this technology. In other words, many variations, modifications and refinements may be made to the mechanisms presented herein without departing from the fundamental inventive concept.

Figure 2:
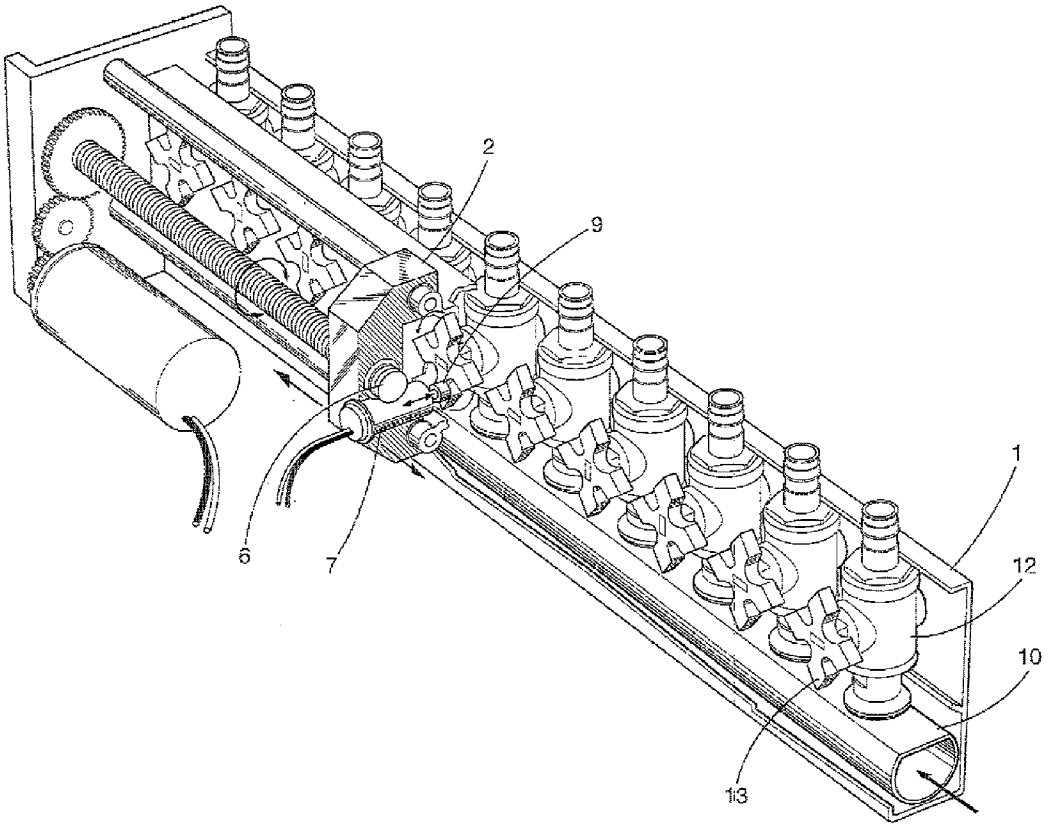
FIG. 2 is an isometric view of the novel supply manifold shown in FIG. 1 but with the carriage and screw drive partially cut away to reveal the details of the solenoid and cross gear.

In general, and with reference to all five figures, the novel supply manifold in accordance with one exemplary embodiment of the present invention has a housing which is designated by reference numeral 1. A carriage 2 (which carries the actuator) is displaced along a longitudinal axis by a screw drive mechanism (or simply a screw drive). This screw drive comprises a bottom guide rail 3, a top guide rail 4 and a screw 5 (or threaded rod). A nut 6 (shown in FIG. 2) is connected to the carriage 2 and is used to drive the carriage along the screw 5. The actuator, which is carried by the carriage 2, may be, for example, a solenoid 7, as also shown in FIG. 2. This solenoid 7 has a ball bearing 9 (or roller bearing or equivalent) at its tip (forward end) as shown by way of example in FIG. 3. The solenoid 7 causes this bearing 9 to engage a cross gear 13 connected to a respective zone valve 12. In this particular example implementation, as the screw drive is advanced, the bearing 9 causes the cross gear 13 to rotate ninety degrees (one quarter turn). This quarter-turn rotation causes the quarter-turn ball valve 12 to open (if it was closed) or to close (if it was open). Once the cross gear 13 has been rotated one quarter turn the bearing 9 is disengaged from the cross gear by the solenoid (or other actuator). The screw drive can be then actuated to move the actuator (solenoid) to another valve for opening or closing as required. The single actuator can thus be displaced to any desired one of the zone valves by the screw drive. Once the screw drive has positioned the actuator in the correct position, the solenoid 7 is actuated to engage the gear cross 13 connected to the zone valve that is to be opened or closed.

Figure 1:
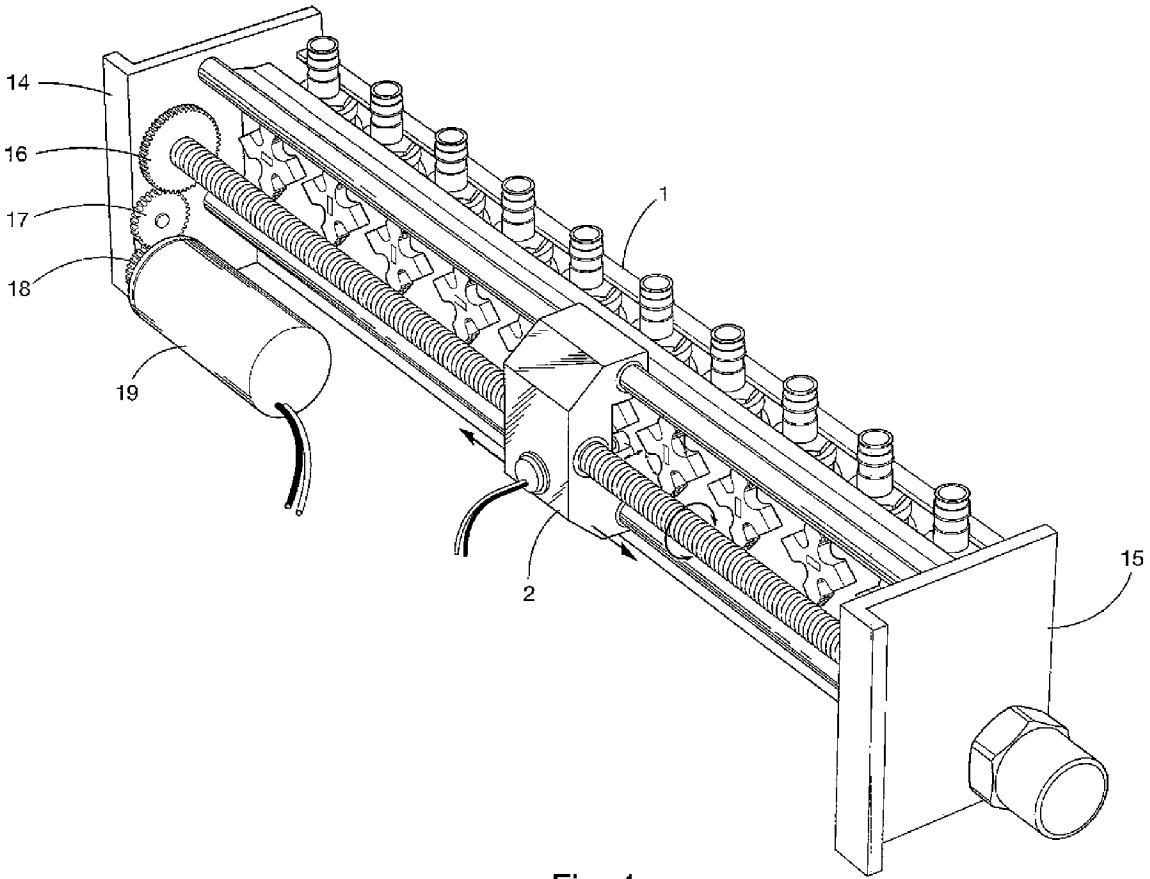
FIG. 1 is an isometric view of a novel supply manifold for a hydronic heating or cooling system in accordance with an embodiment of the present invention.

Further details of the design and construction of this exemplary supply manifold will now be described with reference to FIG. 1. As shown in this figure by way of example, the housing has a pair of end brackets 14, 15. This housing (or case) may be made of metal, plastic or any other suitable material. In this particular implementation, the guide rails 3, 4 and the screw 5 are mounted to the housing. A guide rail glider 8, depicted by way of example in FIG. 3, may be provided to ensure smooth motion of the carriage along the rails. Also mounted to this housing by way of example are the gears 16, 17, 18 and electric motor 19. In this particular implementation, the motor 19 has an output shaft upon which gear 18 is mounted coaxially. As illustrated by way of example, gear 18 drives gear 17 which, in turn, drives gear 16. In this specific implementation, gear 16 is mounted coaxially to the screw 5.

Figure 3:
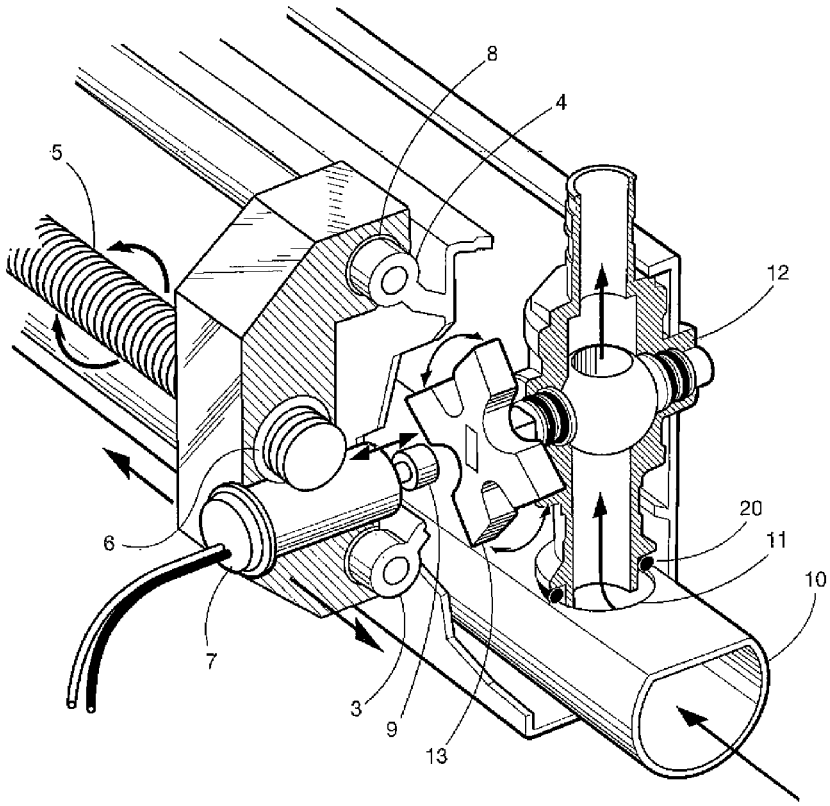
FIG. 3 is an enlarged isometric view of the actuator-displacing mechanism showing the details of the solenoid, cross gear and valve.

The housing 1 also has an inlet and an internal chamber for receiving a heating liquid for a hydronic heating system (or a cooling liquid for a hydronic cooling system). The internal chamber may be, in one exemplary implementation, a flattened copper tubing 10 shown in FIG. 2 and also shown in FIG. 3. The internal chamber is in fluid communication with a linear arrangement of outlets. Each outlet of the manifold has its own inline zone valve 12 as illustrated in FIG. 3. There are ten outlets (and thus ten valves) in the specific manifold presented by way of example in these figures. However, it should be expressly understood that the number of outlets (and associated valves) may be varied.

Each outlet is adapted to connect to a respective conduit or tubing (not shown) for delivering the heating or cooling liquid to a respective zone of the dwelling or building. Each of the plurality of valves controls the flow of heating or cooling liquid from the internal chamber 10 into each respective conduit via holes 11 in the flattened copper tube 10. An O-ring 20 (or other sealing element) provides a fluid-tight seal between the valve body and the upper rim of the hole 11 as illustrated by way of example in FIG. 3.

In this particular implementation, the zone valves are quarter-turn ball valves. Such valves can be opened or closed by a ninety-degree rotation of the ball inside the valve. Accordingly, the cross gear 13 attached to each respective valve has four receptacles for receiving the bearing 9. On each side of the receptacles are outwardly slanted surfaces that terminate in one of four points. This construction ensures that the bearing 9 cannot get stuck on the cross gear 13. In other words, regardless where the bearing 9 engages along the side surface of the cross gear 13, the bearing 9 will be forced into proper engagement with one of the four receptacles.

In one example implementation, the ball bearing (or roller bearing) 9 may be attached to a roller nut and screw. The roller bearing pushes one leg of the cross gear when required to open or close the valve. This will always ensure quarter-turn intervals. In other words, this cross gear acts as an indexing mechanism, rotating in ninety-degree increments. Because of the ball bearing or roller bearing, the mechanism will also have a longer service life. Optionally, sensors (not illustrated but well known in the art) may be attached to the tips of the cross gear 13 to provide signals to a microcontroller. The microcontroller (or microprocessor) can then determine a position of the valve based on the signals received. Any suitable control system and control algorithm can be adapted to operate this mechanism, as is known in the art. The control system may be implemented in hardware, software, firmware or any suitable combination thereof.

Figure 4:
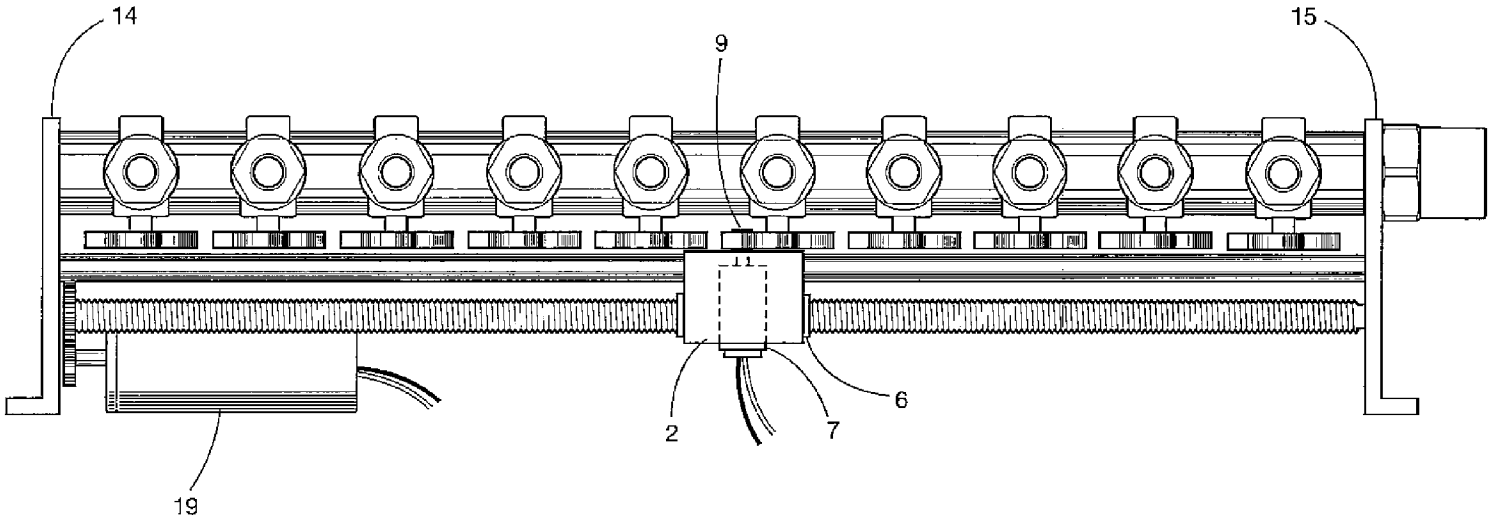
FIG. 4 is a top plan view of the novel supply manifold of FIG. 1.

Further details of the manifold are now described with reference to FIG. 4. Because the valves in the manifold are in a linear arrangement, the actuator can be moved to access any desired valve by simply translating the carriage back and forth along the screw. Since the valves are quarter-turn valves, it does not matter whether the actuator engages from the left or from the right to either open or close any given valve.

Figure 5:
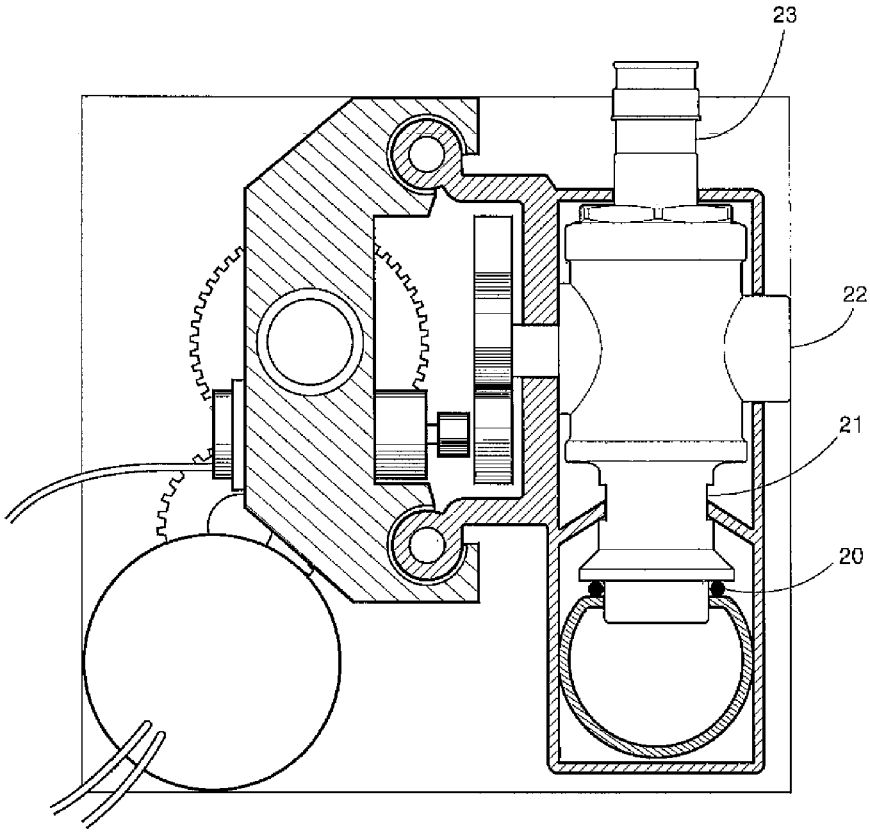
FIG. 5 is a side cross-sectional view of the novel supply manifold of FIG. 1.

Further details are now described with reference to FIG. 5. As illustrated, the manifold may include a flanged holding groove 21 to hold the valve body within the housing. Optionally, the ball valve (zone valve) may be manually operated by providing a suitable drive socket 22 which can be adapted to receive an Allan key, wrench, handle, etc. Also shown by way of example in FIG. 5 is the fitting 23 for connecting to the tubing or conduit. This fitting extends upwardly from the valve as shown by way of example in the figures.

It should be understood that the manifold depicted in FIGS. 1-5 is presented by way of example only. This particular design of the manifold is believed to be the best mode of implementing the present invention but it should be appreciated that many variations in the mechanism(s) presented herein may be effected to achieve essentially the same objective, i.e. displacing a single actuator to actuate any one of a plurality of in-line zone valves.

Variations and Other Embodiments

In broad terms, the manifold may have any mechanism or combination of mechanisms that enable a single actuator to actuate each one of a plurality of zone valves. In the exemplary embodiment described above and illustrated in the appended figures, the manifold employs two mechanisms: a first mechanism for positioning the actuator (i.e. aligning the actuator with a particular valve) and a second mechanism for engaging the actuator. In this exemplary implementation, the first mechanism is also used to rotate the cross gear and thus open (or close) the valve. However, many variations and other embodiments are possible. Some of these variations are described below for the purposes of illustration.

For example, in another embodiment, a first mechanism is used to position the actuator and a second mechanism is used to both engage and open (or close) the valve (i.e. without further displacing the first mechanism). The first mechanism could be, for example, a screw drive, belt drive, pulley system, rack and pinion, etc. The second mechanism could be, for example, a motor mounted on the carriage that drives a worm into engagement with a worm gear attached to the zone valve. Alternatively, as will be appreciated, any suitable combination of gears and/or mechanical linkages can be used to convert the rotational motion of the output shaft of an electric motor into rotation of a gear affixed to a zone valve.

In another embodiment, a single mechanism may be used to position the actuator and to also actuate the valve. For example, a single motor may be mounted on the carriage (instead of mounted to the housing as shown in the exemplary embodiment illustrated in the drawings). This single motor may be coupled via appropriate gears to two drive shafts with can be selectively operated using clutches. When the first clutch is engaged for the first drive shaft, the carriage is displaced longitudinally. When the second clutch is engaged for the second drive shaft, the carriage is displaced orthogonally to engage and open the valve.

In another embodiment, the entire carriage may be movable toward the valve as opposed to just the actuator carried by the carriage.

In another embodiment, the valve may be movable into engagement with the actuator as opposed to the actuator being moved into engagement with the valve.

Many variations in the components and mechanisms are also possible. For example, instead of a screw drive, the first displacement mechanism could use a chain drive, belt drive, pulley system, rack and pinion, or any other known mechanism for positioning the carriage. Instead of a solenoid, as illustrated in the exemplary embodiment, any suitable actuator may be used. In other words, the solenoid could be replaced by an electric motor, hydraulic actuator, pneumatic actuator, shape-memory alloy actuator, or any other type of device that is capable of generating a sufficient force or torque to open and close the valve.

In the exemplary embodiment illustrated in the drawings, a cross gear is used to interact with the bearing tip to open and close the valve. In another embodiment of this invention, the cross gear may be replaced by a standard gear that meshes with a corresponding gear carried by the carriage. In this embodiment, the carriage moves the "carriage gear" into mesh with the "valve gear" (i.e. the gear that is attached to the zone valve). Advancement of the carriage then causes the carriage gear to rotate the valve gear.

In another embodiment of the invention, the ball valve could be replaced by another type of valve which is not necessarily a quarter-turn valve.

Although there are many variations possible, as evidenced by the further example embodiments described in the foregoing paragraphs, this novel supply manifold can be understood in broad terms as an apparatus that uses but a single actuator instead of employing multiple actuators (i.e. instead of having one actuator per valve). This novel manifold is thus less complex and expensive to manufacture.

Method

This technology also enables a novel method of controlling operation of a hydronic system. This method entails delivering water (or any other liquid) into the novel supply manifold, connecting each outlet of the manifold to a respective conduit for a respective zone, and then individually and independently controlling each of the plurality of valves using the single actuator of the supply manifold. Unlike conventional manifolds which have one actuator per valve, this novel manifold has but a single actuator that moves to the valve that it is to open or close. The novel method thus entails a step of displacing the actuator (e.g. solenoid) along a longitudinal axis, e.g. using a screw drive. When the solenoid is at the correct position, the bearing tip of the solenoid is moved (orthogonally to the longitudinal axis) into engagement with one of the four receptacles of the cross gear. The screw drive is then actuated again to advance the carriage and solenoid to thereby turn the cross gear one quarter turn. This opens or closes the valve. The bearing tip of the solenoid is then disengaged from the cross gear. The screw drive may be actuated again to move the solenoid to a new location for actuating a different valve.

The Manifold in a Hydronic System

This novel supply manifold may be incorporated into a hydronic heating or cooling system. This system includes a heater (e.g. boiler) for heating a heating liquid (e.g. water) or alternatively a cooling apparatus for cooling the liquid. The hydronic system also includes a pump for displacing the heating or cooling liquid through the conduits to the various zones.

The Manifold in a Fire Sprinkler System

In another implementation, the manifold may be used for a fire sprinkler system. In this implementation, the outlets would be connected to various conduits or tubing that are in turn connected to sprinkler heads. As will be appreciated, the novel supply manifold may be used for applications other than hydronic heating or hydronic cooling, i.e. any liquid distribution system where a manifold includes a plurality of independently operable valves.

The embodiments of the invention described above are intended to be exemplary only. As will be appreciated by those of ordinary skill in the art, to whom this specification is addressed, many obvious variations, modifications, and refinements can be made to the embodiments presented herein without departing from the spirit and scope of the invention. The scope of the exclusive right sought by the applicant(s) is therefore intended to be limited solely by the appended claims.

The invention claimed is:

1. A supply manifold comprising:

a housing having an inlet and an internal chamber for receiving a liquid;

a plurality of valves disposed on respective outlets of the housing in a linear arrangement, each outlet being adapted to connect to a respective conduit for delivering the liquid to a respective zone, each of the plurality of valves controlling a flow of the liquid from the internal chamber into each respective conduit;

a single actuator for individually actuating one of the valves;

a first displacement mechanism for displacing the actuator along a longitudinal axis that is parallel to the linear arrangement of the valves to thereby access any one of the valves; and a second displacement mechanism for displacing the actuator orthogonally to the longitudinal axis to thereby cause engagement or disengagement of the actuator with a selected one of the valves for opening or closing, wherein each valve comprises a cross gear having four rounded receptacles for engaging a round bearing extending from the solenoid, the cross gear acting as an indexing mechanism to rotate the valve one quarter turn.

2. The supply manifold as claimed in claim 1 wherein:

the plurality of valves are quarter-turn ball valves; and the selected one of the valves is opened or closed by displacement of the actuator into engagement with the selected valve by the second displacement mechanism and subsequent displacement of the actuator along the longitudinal axis by the first displacement mechanism.

3. The supply manifold as claimed in claim 1 or claim 2 wherein the first displacement mechanism is a carriage having a screw drive and a pair of guide rails aligned with the longitudinal axis.

4. The supply manifold as claimed in claim 3 wherein the second displacement mechanism is a solenoid supported by the carriage.

5. The supply manifold as claimed in claim 3 wherein the cross gear has four outwardly slanted surfaces that terminate in four points.

6. A method for operating a hydronic system, the method comprising:

delivering a liquid into a supply manifold having a housing and a plurality of valves disposed on respective outlets of the housing in a linear arrangement;

connecting each outlet to a respective conduit for delivering the liquid to a respective zone;

controlling each of the plurality of valves using the supply manifold by:

displacing an actuator along a longitudinal axis that is parallel to the linear arrangement of the valves to thereby access any one of the valves;

displacing the actuator orthogonally to the longitudinal axis to thereby cause engagement or disengagement of the actuator with a selected one of the valves for opening or closing, wherein each valve comprises a cross gear having four rounded receptacles for engaging a round bearing extending from the solenoid, the cross gear acting as an indexing mechanism to rotate the valve one quarter turn; and causing the selected valve to rotate one quarter turn by further displacing the actuator along the longitudinal axis to thereby open or close the selected valve.

7. The method as claimed in claim 6 wherein displacing the actuator along the longitudinal axis comprises driving a screw drive by an electric motor to advance a carriage holding the actuator along the longitudinal axis.

8. The method as claimed in claim 6 or claim 7 wherein displacing the actuator orthogonally to the longitudinal axis comprises actuating a solenoid such that a bearing affixed to an end of the solenoid engages a cross gear mounted to each valve.

9. A hydronic system comprising:

an apparatus for heating or cooling a liquid;

a pump for displacing the liquid through conduits to various zones; and a supply manifold having:

a housing;

a plurality of valves disposed on respective outlets of the housing in a linear arrangement, each outlet being adapted to connect to one of the conduits;

a single actuator for individually actuating one of the valves;

a first displacement mechanism for displacing the actuator along a longitudinal axis that is parallel to the linear arrangement of the valves to thereby access any one of the valves; and a second displacement mechanism for displacing the actuator orthogonally to the longitudinal axis to thereby cause engagement or disengagement of the actuator with a selected one of the valves for opening or closing, wherein each valve comprises a cross gear having four rounded receptacles for engaging a round bearing extending from the solenoid, the cross gear acting as an indexing mechanism to rotate the valve one quarter turn.

10. The hydronic system as claimed in claim 9 wherein:

the plurality of valves are quarter-turn ball valves; and the selected one of the valves is opened or closed by displacement of the actuator into engagement with the selected valve by the second displacement mechanism and subsequent displacement of the actuator along the longitudinal axis by the first displacement mechanism.

11. The hydronic system as claimed in claim 9 or claim 10 wherein the first displacement mechanism is a carriage having a screw drive and a pair of guide rails aligned with the longitudinal axis.

12. The hydronic system as claimed in claim 11 wherein the second displacement mechanism is a solenoid supported by the carriage.

13. The hydronic system as claimed in claim 11 wherein the cross gear has four outwardly slanted surfaces that terminate in four points.

* * * * *